US005268727A

United States Patent [19]

Thayer et al.

[11] Patent Number: 5,268,727

[45] Date of Patent: Dec. 7, 1993

[54] UNIFORM VELOCITY AIR MANIFOLD

[75] Inventors: Bruce E. Thayer, Webster; Gregory J. Mancine, Fairport, both of N.Y.

[73] Assignee: Xerox Corporation, Stamford, Conn.

[21] Appl. No.: 976,035

[22] Filed: Nov. 13, 1992

[51] Int. Cl.[5] ..... G03G 21/00

[52] U.S. Cl. ..... 355/298; 355/215; 355/296

[58] Field of Search ..... 355/296, 215, 298, 299, 355/301, 302, 77; 15/300.1, 354

[56] References Cited

U.S. PATENT DOCUMENTS

| | | | |
|---|---|---|---|
| 3,706,108 | 12/1972 | Taylor | 355/302 |
| 3,708,823 | 1/1973 | Bell | 15/354 X |
| 3,793,986 | 2/1974 | Latone | 118/637 |
| 4,435,073 | 3/1984 | Miller | 355/298 X |
| 4,459,012 | 7/1984 | Allen et al. | 355/324 |
| 4,601,569 | 7/1986 | Garris | 352/298 X |
| 4,809,035 | 2/1989 | Allen | 355/298 |
| 4,903,084 | 2/1990 | Baltrus et al. | 355/301 |
| 4,910,560 | 3/1990 | Kanada | 355/299 |
| 4,918,488 | 4/1990 | Creveling et al. | 355/296 |
| 4,989,047 | 1/1991 | Jugle et al. | 355/299 X |
| 5,031,000 | 7/1991 | Pozniakas et al. | 355/299 X |
| 5,038,180 | 8/1991 | Niki | 355/298 |
| 5,066,983 | 11/1991 | Tonomoto | 355/298 X |

*Primary Examiner*—A. T. Grimley
*Assistant Examiner*—Sandra L. Brasé
*Attorney, Agent, or Firm*—T. L. Fair

[57] ABSTRACT

An apparatus for cleaning surfaces using uniform air flow through a manifold. The manifold includes an inlet, a collection duct, and an exhaust duct which interact to create uniform air flow through the manifold.

6 Claims, 6 Drawing Sheets

$$V_{duct\,i} = Q_i / A_i = V_{IN}\,\Delta G(i)(t) / 1/4\,\pi\, d_i^2$$

$$P_i = P_{i-1} + \Delta P_i = \Sigma \Delta P_i$$

$Q_{left} = Q_{left} \times \text{inlet gap} \times V_{INLET}$ $Q_{right} = Q_{right} \times \text{inlet gap} \times V_{INLET}$

UNIFORM VELOCITY AIR MANIFOLD

BACKGROUND OF THE INVENTION

This invention relates generally to an electrostatographic copier or printer, and more particularly, concerns a cleaning apparatus using uniform air velocity. In an electrophotographic application such as xerography, a charge retentive surface (i.e., photoconductor, photoreceptor or imaging surface) is electrostatically charged, and exposed to a light pattern of an original image to be reproduced to selectively discharge the surface in accordance therewith. The resulting pattern of charged and discharged areas on that surface form an electrostatic charge pattern (an electrostatic latent image) conforming to the original image. The latent image is developed by contacting it with a finely divided electrostatically attractable powder referred to as "toner". Toner is held on the image areas by the electrostatic charge on the surface. Thus, a toner image is produced in conformity with a light image of the original being reproduced. The toner image may then be transferred to a substrate (e.g., paper), and the image affixed thereto to form a permanent record of the image to be reproduced. Subsequent to development, excess toner left on the charge retentive surface is cleaned from the surface. The process is well known, and useful for light lens copying from an original, and printing applications from electronically generated or stored originals, where a charge surface may be imagewise discharged in a variety of ways. Ion projection devices where a charge is imagewise deposited on a charge retentive substrate operate similarly.

Although a preponderance of the toner forming the image is transferred to the paper during transfer, some toner invariably remains on the charge retentive surface, it being held thereto by relatively high electrostatic and/or mechanical forces. Additionally, paper fibers, Kaolin and other debris have a tendency to be attracted to the charge retentive surface. It is essential for optimum operation that the toner remaining on the surface be cleaned thoroughly therefrom.

A commercially successful mode of cleaning employed on automatic xerographic devices utilizes a brush with soft conductive fiber bristles or with insulative soft bristles which have suitable triboelectric characteristics. While the bristles are soft for the insulative brush, they provide sufficient mechanical force to dislodge residual toner particles from the charge retentive surface. In the case of the conductive brush, the brush is usually electrically biased to provide an electrostatic force for toner detachment from the charge retentive surface. Toner particles adhere to the fibers (i.e. bristles) of the brush after the charge retentive surface has been cleaned. The process of removing toner from these types of cleaner brushes can be accomplished in many ways. Typically, brush cleaners, use flicker bars to provide the detoning function.

Problems that can be associated with flicker bar detoning include damage to the cleaner brush as a result of the high impact forces at the point of contact, resulting in shorter brush lives and, higher cleaner unit manufacturing cost (UMC) due to periodic replacement or cleaning of the flicker bars.

Typically, rotary brush cleaners also encounter problems with photoreceptor filming and abrasion, and toner emissions. The filming and abrasion are due to the high impact forces that result when the brush fibers strike the toner and photoreceptor. Toner emissions usually result from inadequate or non-uniform air flow entering the cleaner at the housing to photoreceptor gaps.

High velocity air streams have been used to clean photoreceptors in the past. Photoreceptors and BTRs, have used air knives to create a high velocity air stream to clean their surfaces. Such devices can consist of a plate, closely spaced to the surface to be cleaned, with narrow slots cut into it. A vacuum is applied behind the plate to cause air to flow through the slots and create a high velocity airstream across the surface being cleaned. The high velocity air flow disturbs the surface boundary layer allowing removal of particles adhered to the surface. The problems with this approach are in the manufacture of the device and the power required to create the vacuum. The tolerances for the cleaner and the surface to be cleaned must be held closely. The orifice slot width must be uniform along its length to maintain uniform air velocities and therefore cleaning. The spacing between the plate and surface to be cleaned must also be uniform for the same reasons. This requires the plate and cleaning surface to be straight, flat and well aligned. If the surface to be cleaned is a roll, the runout of the roll and the parallelism of the roll axis to the slot axis is also important. Because of the close spacing of the cleaning plate to the surface to be cleaned and the narrow orifice slot, the resistance of the system to air flow is very high. As a result of this high resistance to air flow, a considerable air flow is required to generate the required cleaning air velocities needed for the narrow orifice slot to clean the surface. The requirements of high pressure and air flow result in a high power usage for the system and the possibility of a noise problem.

In practice, toner often times is not completely removed from the chamber of the cleaning apparatus due to uneven air flow over the length of the brush and within the chamber. This uneven air flow causes nonuniform cleaning of the rotating brush and results in deposition of the toner in areas of the chamber where the air flow velocity becomes too low to transport toner. Eventually, air flow and cleaning efficiency can be reduced to a point where residual toner material is left on the photoconductive member and is transferred to subsequent receiver sheets resulting in copies with ghost images or high density background.

The following disclosures may be relevant to various aspects of the present invention and may be briefly summarized as follows:

U.S. Pat. No. 4,459,012 to Allen et al. discloses a cleaning apparatus having a manifold housing which partially encloses a rotating brush. A chamber, defined by the manifold housing, has a plurality of air flow dividers disposed therein forming channels extending from a position spaced near the brush into an outlet port which is coupled to a vacuum source. These channels direct air flow across the cleaner brush to remove toner therefrom.

U.S. Pat. No. 4,809,035 to Allen, Jr. discloses an apparatus for separating and removing non-magnetic lubricating particles. An air manifold assembly, having a blower, is mounted on the toner unit housing, of the unwanted particle chamber, to draw the unwanted particles from such chamber.

U.S. Pat. No. 3,793,986 to Latone discloses a toner powder reclaiming system for use in conjunction with a photoreceptor cleaning device. The system includes a particle separator in the path of movement of air flow containing toner particles from a brush cleaning device. The toner particles are separated from cleaning debris particles and conveyed to a collection manifold and thence to collecting containers.

SUMMARY OF INVENTION

Briefly stated, and in accordance with one aspect of the present invention, there is provided an apparatus for removing particles from a surface. The apparatus includes a housing and a cleaning means at least partially enclosed in the housing, for dislodging toner particles from the surface. Manifold means, connected to the housing, for creating a uniform air flow. Vacuum means, connected to said manifold for generating air flow through said manifold.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Reference is now made to the drawings where the showings are for the purpose of illustrating a preferred embodiment of the invention and not for limiting same.

Figure 1:
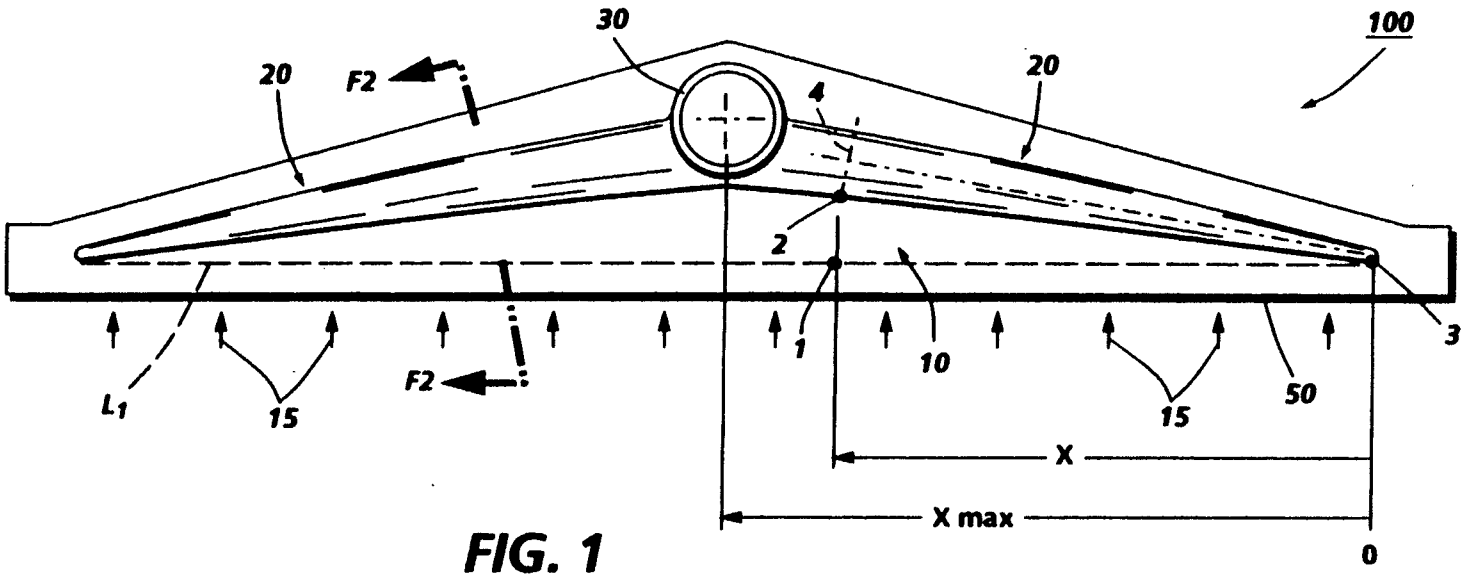
FIG. 1 is a schematic elevational view of the preferred embodiment of the uniform air flow manifold having a centered exhaust duct.

Referring now to FIG. 1, which shows a schematic elevational view of the uniform air flow manifold. The uniform air flow section of the manifold has three regions. The first is the triangular inlet region or narrow gap region 10. This is a narrow constant gap slot having uniform, constant velocity, and parallel air flow streams through it. The base of the triangular inlet region 10 is indicated by an imaginary line, $L_1$, drawn from the opposing end points of the second region called the collection duct 20. The collection duct 20 is located just above the triangular inlet region 10. The bent architecture of the collection duct 20 forms the top two diagonal sides of the triangular inlet region 10. The collection duct 20 (shown here as a circular cross-section duct) collects air flow exiting the triangular inlet region 10 and transports the collected air flow to a third region, the exhaust duct 30. The preferred embodiment of the exhaust duct 30 in the invention is for the exhaust duct 30 to be centrally located near the apex of the triangular configuration of the manifold 100 and, partially on the collection ducts 20 where they meet. For ease of calculation and manufacture (the manifold is molded from a plastic material in it's preferred embodiment), the collection duct region is chosen as a convenient cross-sectional shape, e.g., circular, rectangular or square. The lowest drag cross-section is circular. The air flow entering the manifold into the narrow constant gap region is designed to be uniform, as shown by the arrows 15. The air flow is parallel through the narrow gap region 10 until it enters the collection duct 20. The collection duct 20 collects the flows from the narrow gap region 10 and directs them to the exhaust duct 30 at the peak of the triangular narrow gap region 10. The exhaust duct 30 is connected by a hose to the air system. The velocities at the inlet slot 50 remain uniform because the collection duct 20 diameters are chosen such that the pressure drops for all air streams passing through any cross-section of the collection duct 20 are equal at a constant inlet velocity.

With continued reference to FIG. 1, at the inlet gap 50, the air velocities are the same at every location. Points 1–4 are included in this figure, where point 1 is a point along $L_1$ at the inlet of the triangular narrow gap region 10 of the manifold 100, at some distance between 0 and $X_{max}$. Point 2 is located directly above point 1 at the intersection of the triangular narrow gap region 10 and the collection duct 20. Point 3 is the end point at the edge of the collection duct 20 at location 0. Point 4 is a point along a plane perpendicular to the air flow through the collection duct and adjacent to point 2, where the pressure is assumed constant along the plane. The velocity remains constant through the narrow gap region 10, point 1 to point 2, at location X, where X is the distance along the manifold inlet, from 0 to the center point of the exhaust duct, $X_{max}$. The pressure drop experienced by this flow is fairly easily estimated as a constant velocity air flow through a constant gap channel of the length from point 1 to point 2. The air flow exits the narrow gap region at point 2 and joins the cumulative air flow at point 4. The flow at point 4 is the sum of the air flows entering the inlet between point 1 and point 3. The pressure drop of the air flow traveling from point 3 to point 4 must match the pressure drop from point 1 to point 2. The collection duct 20 air flow increases linearly from the ends due to the uniform inlet velocity in accordance with the equation: $Q_x = V_{INLET}$ x gap x X. [$Q_x$ is the air flow through the plane at 4, $V_{INLET}$ is the inlet velocity, gap refers to the distance between the front half of the manifold and the second half of the manifold (see the cross section of the inlet area, dimension W, in FIG. 2) and is the distance along the inlet from 0 to $X_{max}$.] Since the pressure drop is proportional to the path length (i.e. the path length from point 3 to point 4) and the path length increases linearly from the edges of the triangular inlet region 10 to the center, then the pressure drop increases linearly from zero at the edges to a maximum at the center of the manifold. The velocity remains constant on the other half of the manifold in a similar manner as that just described. Therefore, the pressure drop and flow required for uniform inlet flow is known at all collection duct 20 locations, X. From this information it is possible to compute the collection duct diameters which will result in the required pressure drops at the specified air flows for all locations, X. When these relationships hold at all locations, X, then a manifold with a uniform inlet air flow will result. The exhaust duct 30 diameter is chosen to result in an area equal to the converging areas of the left side of the manifold and the right side of the manifold collection ducts 20. The manifold 100 is designed by specifying the center height ($H_{CTR}$, see FIG. 9) of the narrow gap region 10, the narrow gap region gap width (W, see FIG. 2), the collection duct 20 cross-sectional shape and either the total air flow through the manifold 100 or the inlet velocity 15. The collection duct size can then be calculated and the inlet velocity, collection duct velocity, total air flow and pressure drop for the manifold 100 found. An acceptable design must fit into the available space, have narrow gap and duct velocities high enough to prevent blocking (preferably greater than 50 ft/sec) and have pressure/flow characteristics which are compatible with the air system and machine power requirements. Manifolds may be designed to give uniform inlet air flow for a wide range of manifold heights. In practice the space available for the manifold is at least roughly known. This will put a limit on the allowable height of the triangular narrow gap region 10, the collection duct 20 and the exhaust duct 30. The height of the narrow gap region 10 may be tentatively chosen, the collection duct size calculated and the exhaust duct diameter added to determine the total manifold height. If this resulting height is too large, a smaller height is then chosen, a new manifold height calculated, and the process repeated until an acceptable height is found. Very short manifold designs are possible but at the cost of increasing manifold pressure drop. This increase in manifold pressure drop occurs because narrower gaps are required in the narrow gap region to develop a pressure drop through the center height of a short manifold equal to the pressure drop through the length of the duct from an end to the center. (Increasing the duct size to reduce the required pressure drop through the narrow gap region, may result in manifolds which are too large.)

Figure 2:
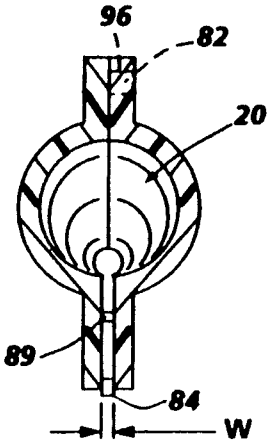
FIG. 2 is a sectional elevational view taken along the line F2 in the direction of the arrows in FIG. 1.

Referring now to FIG. 2, which shows section F2 of FIG. 1. The figure shows the cross-section of the circular collection duct 20. The width, W, of the inlet opening between the manifold walls through the narrow gap region is shown. Spacers 84 and nodules 89 maintain the opening of the narrow gap region when air flows therethrough.

Figure 3:
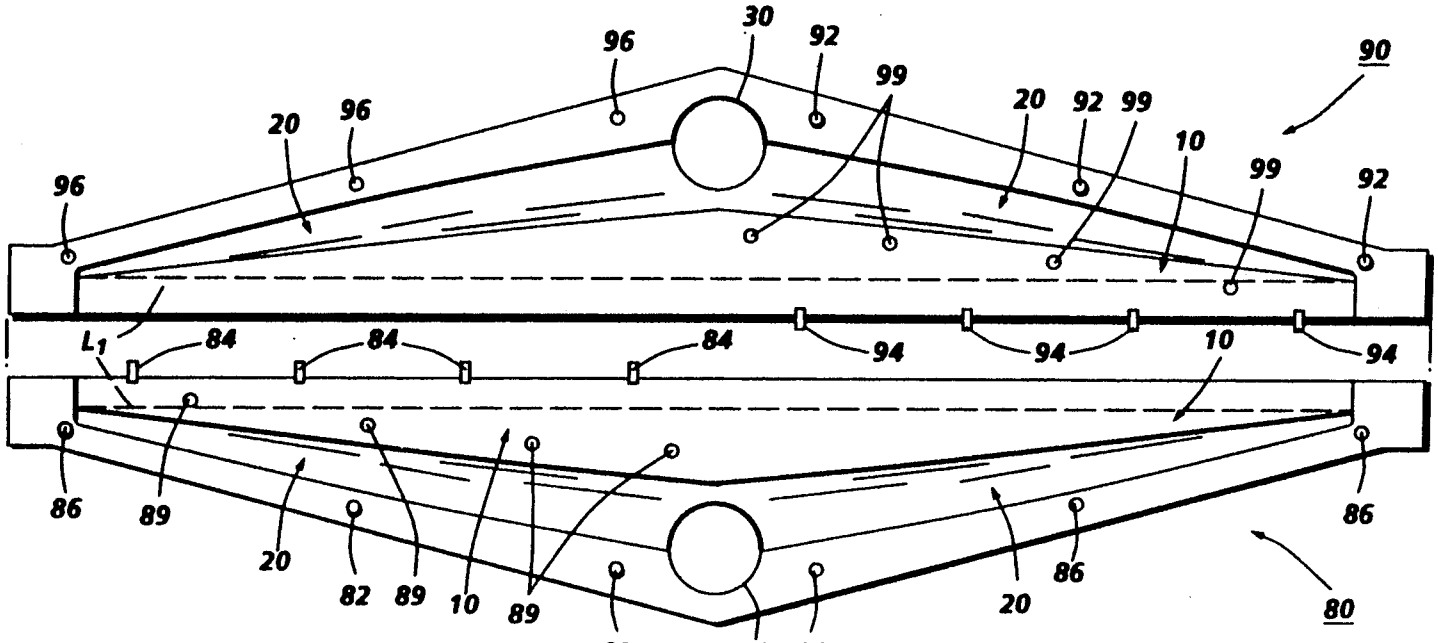
FIG. 3 is a schematic side elevational view of the front and back members of the manifold.

Referring now to FIG. 3, which shows the front and back halves of the manifold. The front half 80 contains receiving holes 82 along one diagonal side of the manifold and pegs 86 along the other diagonal side of the front half of the manifold. The back half 90 contains receiving holes 92 along the diagonal side of the manifold opposite the pegs 86 in the front half 80 of the manifold and the back half 90 contains pegs 96 along the diagonal side of the manifold opposite the receiving holes 82 of the front half 80 so that the two halves 80, 90 can be interconnected and aligned by the respective pegs 86, 96 in the appropriate receiving holes 82, 92. (See FIG. 2 which shows peg 96 in receiving hole 82.) The bottom length of both the front 80 and back 90 halves of the manifold contain relief elements called spacers 84, 94 to maintain the narrow inlet slot 50 when the manifold halves are connected together and a vacuum is applied to the manifold. One half of the base of the front half 80 of the manifold contains spacers 84 and the opposite half side of the the base of the back half 90 of the manifold contains spacers 94 such that when both halves are connected together the base of the manifold has spacers along the entire length of the base. All of these spacers are of a small enough size that minimal disruption to the air flow through the manifold is experienced. In order to prevent the walls of the manifold from collapsing, nodules 99 are placed on the back inner wall surface of the manifold and nodules 89 are placed on the front inner wall surface of the manifold.

Figure 4A:
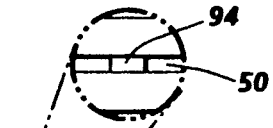
FIGS. 4 and 4A is a side elevational view of the inlet slot in the bottom of the manifold.
Figure 4:
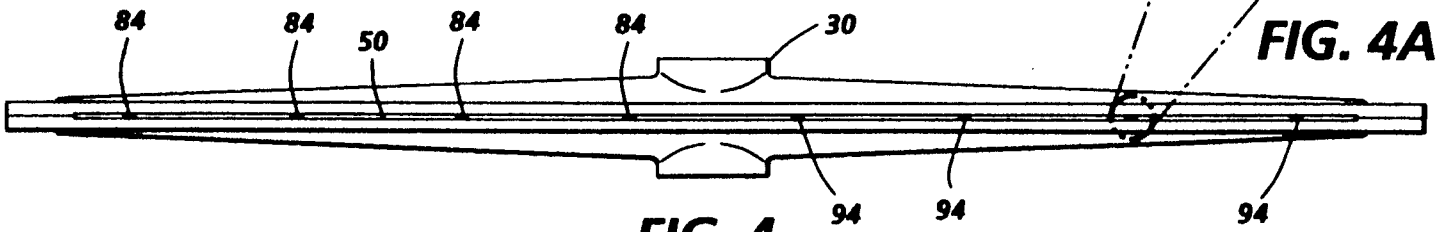

Referring now to FIG. 4, which shows the inlet gap of the manifold. The inlet slot or gap 50 has an opening (shown as w in FIG. 2) whose width is maintained by spacers 84, 94 as air flows through the manifold. An enlargement of a section of the inlet slot 50 having a spacer 94 therebetween is shown.

Figure 5:
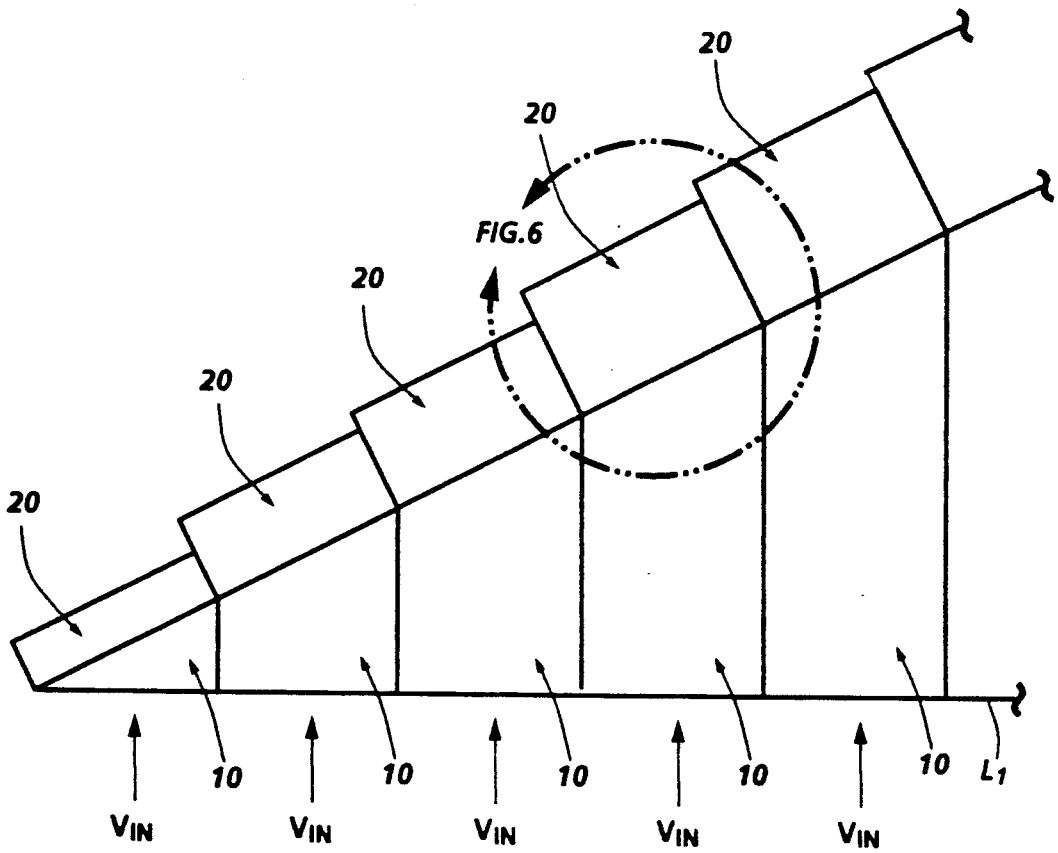
FIG. 5 is a diagrammatic view showing a portion of a manifold, sectioned into areas, to enable an approximation of pressure drop and diameter change through the circular duct region of the manifold.
Figure 6:
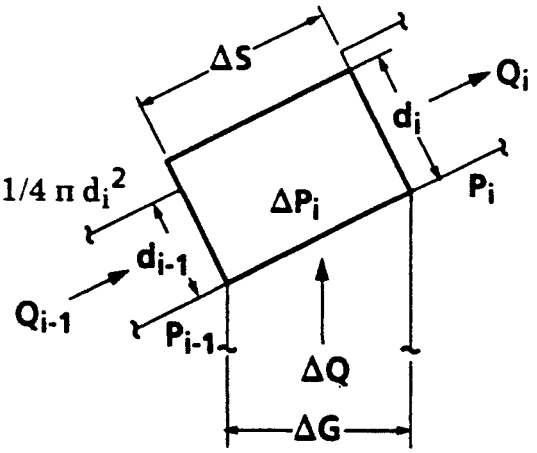
FIG. 6 is an enlarged elevational view of section 6 shown in FIG. 5.

Referring now to FIGS. 5 and 6, which show an approximation of pressure drop and diameter change through the circular duct region 20 of the manifold. FIG. 5 is a diagrammatic view of a portion of the triangular inlet region for calculating air flow. Each calculation interval is assumed to be a constant cross-section, circular duct with diameter $d_i$ and change in length $\Delta S$ (see FIG. 6), with pressures, flows and velocities calculated at the right side of the duct section.

With continued reference to FIG. 5, once the pressure drop for any vertical section through the triangular inlet region 10 is known, the pressure drop through the collection duct region 20 must be matched to it. This will maintain the desired uniform inlet velocity, $V_{IN}$, assumed in the triangular inlet region 10 pressure drop calculations. To obtain the required pressure drops the collection duct diameters must change from the edges to the center of the manifold such that the velocity and resistance in each section total the required matching pressure drop. These calculations have been performed by approximating the collection duct 20 as a series of finite length pipes of constant diameter. A series of about 25 such pipe sections for each half of the manifold 100 was found to provide adequate accuracy. (The number of pipe sections is not limited to 25, the number can be greater or smaller.) Also noted was the variation in collection duct diameters required to obtain the required matching pressure drop distribution was the same for all sized manifolds of this design (triangular constant velocity inlet region and circular collection duct region). This diameter variation was found to follow a relation of the form $d=AX^B$ where d is the duct diameter, X is the distance along the inlet from an edge to the center of the manifold and A and B are constants. This relation simplifies the calculations to where if one diameter (the largest collection duct diameter adjacent to the exhaust duct is most convenient) is known then all of the other diameters will be known.

Referring now to FIG. 6, which shows an enlarged view of section 6 of FIG. 5, the pressure at a particular calculation interval, $P_i$, is the pressure drop, $\Delta P_i$, across that particular duct section plus the summation of all of the pressure drops across the preceding duct sections $$\sum_{n=1}^{i-1} \Delta P_n = P_{i-1}$$

where ("i" is the number of the duct section from 1 to 25).

With continued reference to FIG. 6, the velocity of the air flow through the duct pipe sections, $V_{duct\ i}$, is determined by the equation $V_{duct\ i}=Q_i/A_i$. $Q_i$ is the air flow rate through pipe section "i" (i.e. 1 to 25) and is determined by the product of $V_{IN}\Delta G(i)(t)$ where $V_{IN}$ is the uniform inlet velocity, $\Delta G$ is the width of each of the manifold pipe sections, "i" is the number of separate pipe sections (i.e. 1 to 25) and "t" is the gap size of the inlet. $A_i$ is the cross-sectional area of the pipe and is determined by the product of $\frac{1}{4}\pi d_i^2$ where $d_i$ is the diameter of the pipe section "i" and $\pi=3.141592654$.

FIG. 6 also shows $\Delta Q$ which indicates a change in the air flow rate of the duct pipe section from $Q_{i-1}$: the air flow rate entering the duct pipe, to $Q_i$: the air flow rate exiting the duct pipe section. The change in pipe section duct diameter is indicated in a similar manner in FIG. 6 by the variables $d_{i-1}$ and $d_i$.

Figures 7, 7A:
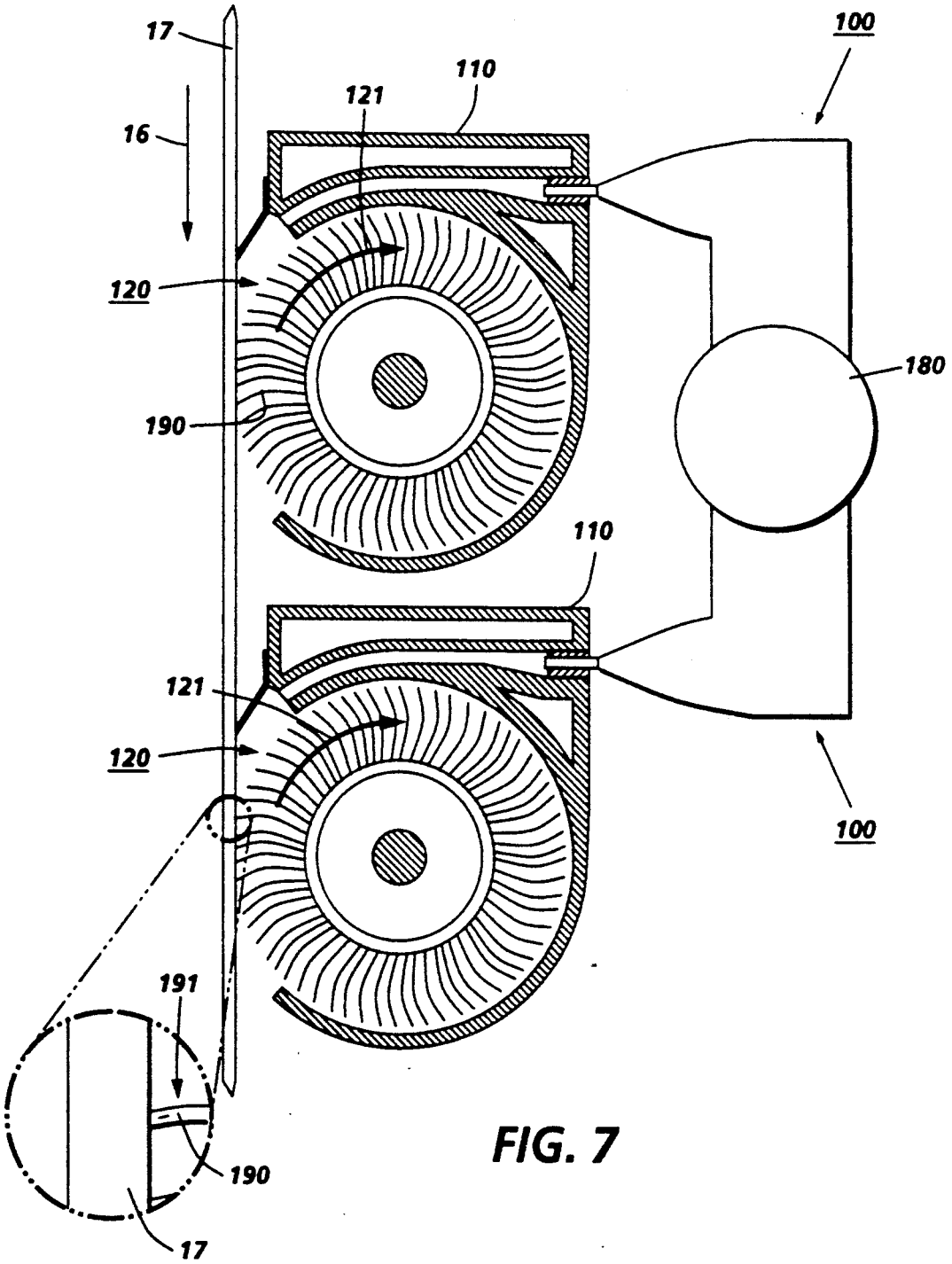
FIGS. 7 and 7A is an elevational view of two uniform air manifolds connected to each other and to two brush cleaner housings.

Referring now to FIG. 7, which shows how the manifold can be attached to a cleaner housing. In this figure, there are two manifolds 100 attached to the cleaner housings 110 of brush cleaners 120. The two manifolds are attached to each other by a connecting device 180. The brush cleaners 120 rotate in the direction of arrow 121. The brush fibers 190 impact against the photoreceptive surface 17 to clean the surface of residual particles. The photoreceptive surface moves in the direction of arrow 16. An enlargement of the brush fiber 190 shows it's cylindrical surface 191 which is a surface the present invention can be used to clean. This is just one embodiment of the invention. There can be one or more manifolds 100 as shown in FIG. 7. The cleaning device does not have to be a brush cleaner, it can be a blade or an air knife or any other cleaning mechanism to which the manifold 100 can be attached to clean an imaging surface.

Figure 8:
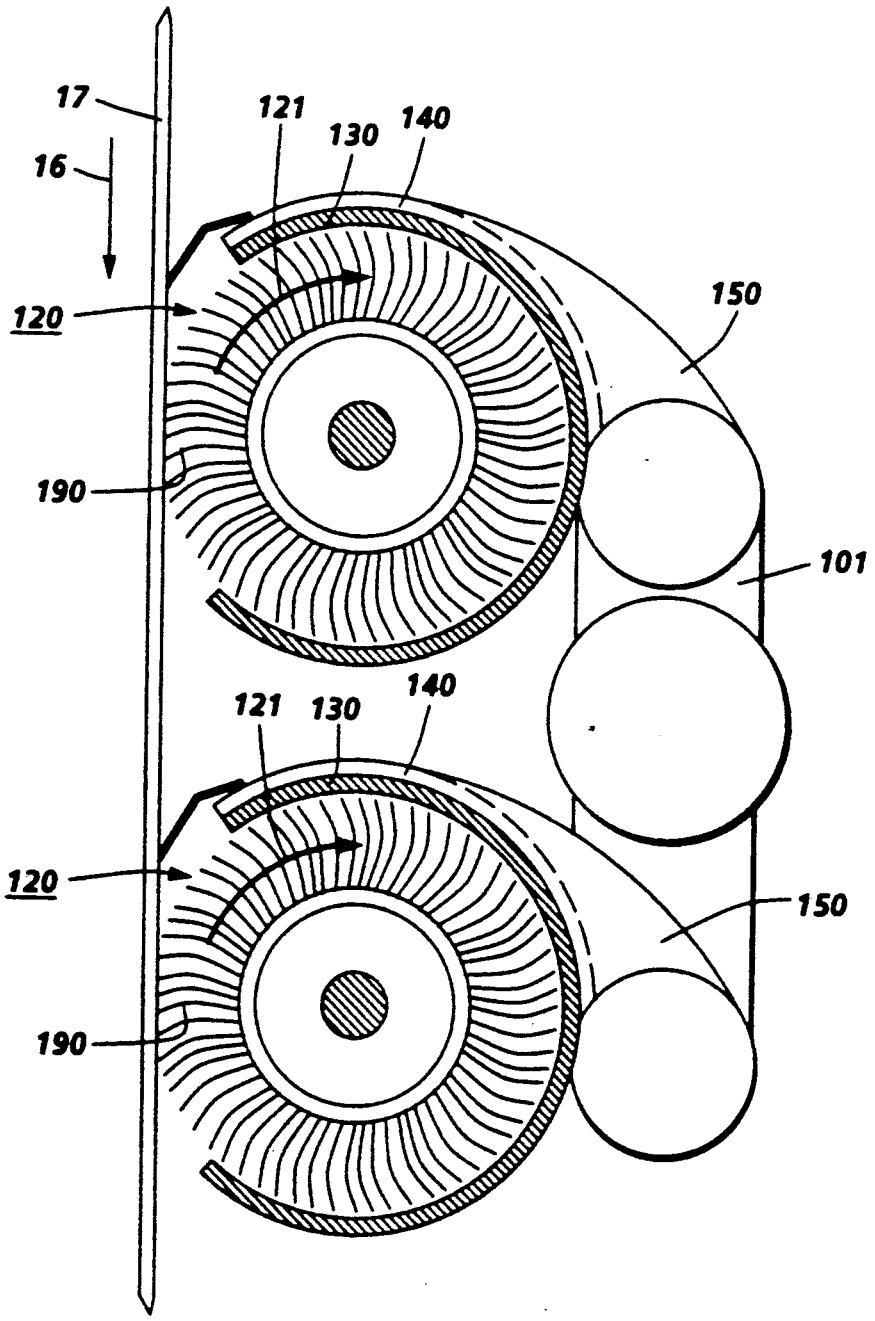
FIG. 8 shows an elevational view of a wrap around manifold embodiment.

Referring now to FIG. 8 which shows another embodiment of the present invention in which the manifold 101 is wrapped around the cylindrical cleaner housing. The two piece straight manifold 100 (shown in FIG. 7) becomes a single molded piece manifold 101 which is attached to the cleaner housing 130 which becomes the second side of the manifold. The inlet gap region 140 is curved such that the air inlet flow path length is the same as it was for the straight manifold. The collection duct region 150 diameters are shifted to the molded piece side of the manifold. This modified manifold would be expected to have slightly higher pressure losses than the straight manifold due to the curved flow path, but significant reductions in space of the total assembly are possible. Since the modified manifold 101 uses the cleaner housing as one of its walls, the problem of aligning the manifold inlet slot to a matching slot in the cleaner housing is eliminated.

Figure 9:
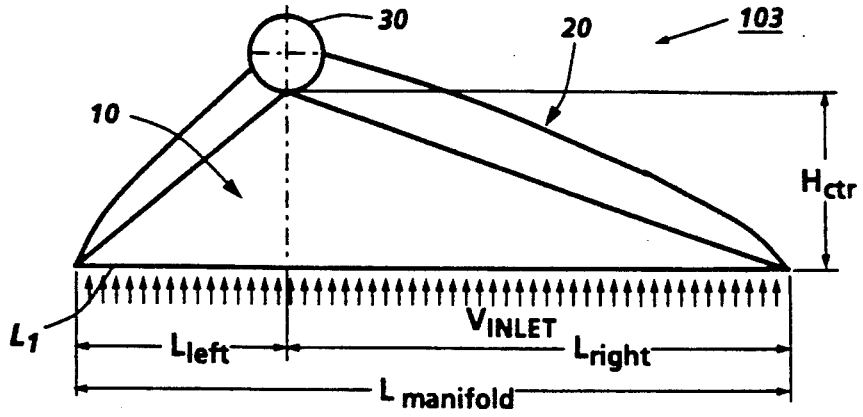
FIG. 9 shows a schematic elevational view of the uniform air flow manifold with an off center exhaust duct.
Figure 10:
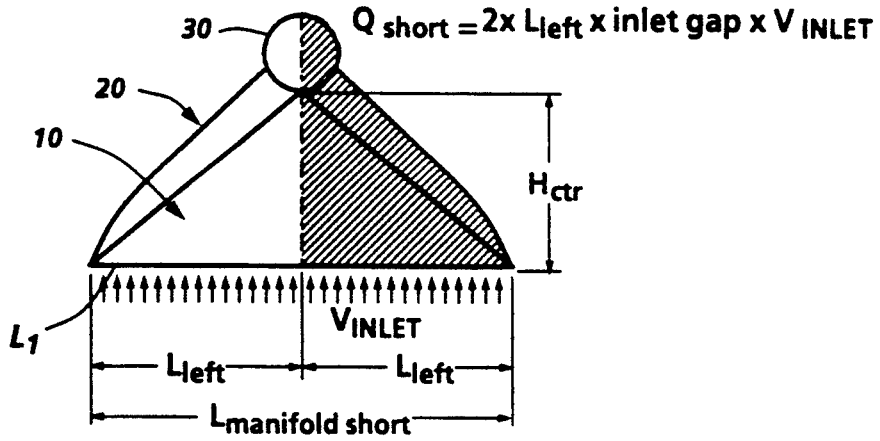
FIG. 10 shows a schematic of a manifold used to calculate the air flow of the short length side of the manifold of FIG. 9.
Figure 11:
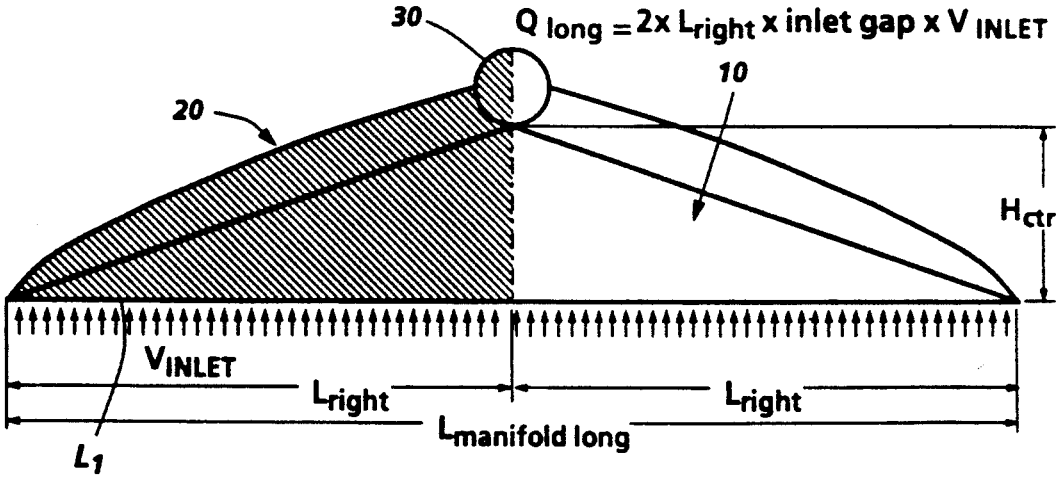
FIG. 11 shows a schematic of a manifold of long length used to calculate the air flow of the long length side of the manifold of FIG. 9.

Referring now to FIG. 9 which shows yet another embodiment of the present invention in which the manifold exhaust duct 30 is located off center. In this embodiment of the invention, it is advantageous to locate the manifold exhaust duct 30 off center from the manifold inlet 50. This may be required in some cleaners due to adjacent machine elements interfering with the routing of a centered exhaust duct. In calculating the collection duct diameters for this modified manifold 103, each side of the manifold from an edge to the exhaust duct 30 is treated separately as though it were half of a shorter centered manifold, FIG. 10, and half of a longer centered manifold FIG. 11. In FIG. 9, the left side of the manifold is shown as the shorter side of the manifold. FIG. 10 shows how to calculate $Q_{left}$ which is the air flow through the collection duct 30 on the left side by taking the product of the variables: $L_{left}$ (length of $L_1$, the bottom of the triangular inlet region 10 from the left edge to the middle of the exhaust duct 30), inlet gap (distance between the front and back manifold in the narrow gap region 10), and $V_{INLET}$ (the inlet velocity). (Twice the product of the product of these variables is calculated because of the symmetry of the triangle in FIG. 10 to determine $Q_{short}$.) Similarly, FIG. 11 shows how to calculate $Q_{right}$ the air flow through the collection duct on the longer right side of the manifold 103 shown in FIG. 9. (Twice the product of $Q_{right}=Q_{long}$.)

In recapitulation, the apparatus for removing particles from a surface utilizes a manifold having three regions. The three regions include a triangular inlet region, a collection duct region and an exhaust duct region. The triangular inlet includes a narrow constant gap slot along the length of the manifold through which stream of parallel air flow through uniformly. The collection duct is adjacent to the triangular inlet and collects the air flow exiting from the triangular inlet. The exhaust duct, in it's preferred embodiment, is centrally located at the apex of the triangular manifold, partially situated on the collection ducts where they meet. The exhaust duct provides an exit for the air being transported by the collection ducts. The combination of these three regions provide uniform air flow velocity through the manifold.

It is, therefore, apparent that there has been provided in accordance with the present invention, a uniform velocity air manifold that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. An apparatus for removing particles from a surface, comprising:

a housing;

cleaning means at least partially enclosed in said housing, for dislodging toner particles from the surface;

a manifold including a triangular shaped housing having an apex and a bottom surface, with the apex being one endpoint of said triangular shaped housing and the bottom surface, located opposite said apex, being the distance between the other endpoints of said triangular shaped housing, an inlet, defining a substantially narrow constant gap slot, extending along one side of said triangularly shaped housing to form a substantially uniform constant velocity stream of substantially parallel air flow therethrough; a collection duct, being adjacent to said inlet, for collecting air flow exiting said inlet; and an exhaust duct, being located partially on said collection duct, adjacent to the apex of said triangular shaped housing, through which air exits said triangularly shaped housing, said manifold connected to said housing, for creating a uniform air flow through said housing; and vacuum means, connected to said manifold, for generating air flow through said manifold.

2. An apparatus as recited in claim 1, wherein said triangular shaped housing comprises a front member including an inner front portion and an outer front portion, and a back member including an inner back portion and an outer back portion with the inner front portion and the inner back portion being connected to each other.

3. An apparatus as recited in claim 2, wherein said triangularly shaped member comprises a plurality of spacers, positioned on the inner front portion and the inner back portion, said plurality of spacers defining a narrow gap between said front member and said back member with an inlet slot, located along the bottom of said manifold, being an entrance to the narrow gap.

4. An apparatus as recited in claim 3, wherein the surface comprises an imaging surface.

5. An apparatus as recited in claim 3, further comprising:

a cleaner brush having a plurality of fibers; and a flexible seal having one end attached to said housing, on an upstream side of said cleaner brush in the direction of movement of the surface, and having the opposite end tangentially contacting said imaging surface, said housing having an outlet for air to exit therefrom, and a detoning entrance area for removing toner from said fibers as the air entrained with toner exits the housing through the outlet.

6. An apparatus as recited in claim 5, wherein the surface comprises a cylindrical surface of said fibers of a cleaning brush.

* * * * *